US005967456A

United States Patent [19]

Michalik

[11] Patent Number: 5,967,456

[45] Date of Patent: Oct. 19, 1999

[54] TURNING ROD

[75] Inventor: Horst Bernhard Michalik, Höchberg, Germany

[73] Assignee: Koenig & Bauer-Albert Aktiengesellschaft, Wurzburg, Germany

[21] Appl. No.: 09/068,336

[22] PCT Filed: Nov. 7, 1996

[86] PCT No.: PCT/DE96/02129

§ 371 Date: May 8, 1998

§ 102(e) Date: May 8, 1998

[87] PCT Pub. No.: WO97/17202

PCT Pub. Date: May 15, 1997

[30] Foreign Application Priority Data

Nov. 8, 1995 [DE] Germany ..... 195 41 578

[51] Int. Cl.[6] ..... B65H 20/00

[52] U.S. Cl. ..... 242/615.12; 226/91; 226/172

[58] Field of Search ..... 242/615.12, 615.21; 226/91, 92, 172

[56] References Cited

U.S. PATENT DOCUMENTS

| | | | |
|---|---|---|---|
| 4,154,386 | 5/1979 | Kawada | 242/615.21 X |
| 4,453,465 | 6/1984 | Heller et al. | 242/615.12 |
| 4,467,950 | 8/1984 | Karlsson et al. | 226/91 |
| 4,889,269 | 12/1989 | Long et al. | 242/615.12 |
| 5,273,201 | 12/1993 | Hambrecht et al. | 242/615.12 |
| 5,357,859 | 10/1994 | Eckert . | |
| 5,520,317 | 5/1996 | Eckert et al. | 242/615.12 |
| 5,525,602 | 6/1996 | Mamberer et al. . | |

FOREIGN PATENT DOCUMENTS

| | | |
|---|---|---|
| 582927 | 2/1994 | European Pat. Off. . |
| 3131621 | 6/1982 | Germany . |
| 9114974 | 3/1992 | Germany . |
| 4130678 | 3/1995 | Germany . |
| 60-248554 | 12/1985 | Japan . |
| 4-055254 | 2/1992 | Japan . |
| 4-078536 | 3/1992 | Japan . |
| 1029761 | 5/1996 | United Kingdom . |

*Primary Examiner*—Michael R. Mansen
*Attorney, Agent, or Firm*—Jones, Tullar & Cooper, P.C.

[57] ABSTRACT

A turning rod is used to change the direction of travel of a paper web. A guide tube is supported between spaced holders and is provided with air outlets in one side. The guide tube is rotatable about its longitudinal axis through generally 180°. At least one of the guide tube holders has a helical guide groove that will receive a paper web guide belt.

10 Claims, 1 Drawing Sheet

TURNING ROD

FIELD OF INVENTION

The present invention relates to a turning rod for deflecting a material web. The turning rod can be charged with compressed air and has air outlet openings on an outer guide tube which is supported for rotation about its longitudinal axis.

DESCRIPTION OF THE PRIOR ART

It is known to divide paper webs, for example, in web-fed rotary printing presses, after printing of the webs into two or more partial paper webs by means of one or more longitudinal cutting devices. These partial paper webs are placed one above the other by means of turning rods, with or without reversing them and in variable sequences, to form a train. As a rule, the turning rods are horizontally arranged in a lateral frame at an angle of 45°.

If, in connection with a path of travel of a partial paper web parallel with the lateral frame, feeding of the partial paper web takes place on the right side of the frame instead of feeding of the partial paper web taking place on the left side of frame, for example for the purpose of merging paper webs, it is disadvantageous, in connection with the above mentioned turning rod arrangement, that it is necessary to either convert the turning rod or to replace it, so that an air cushion is provided between the turning rod and the partial paper web.

A turning rod is furthermore known from DE 41 30 678 A1, which has a helical groove for guiding a draw-in belt that is arranged next to the guide area of the partial paper web.

In this case, it is disadvantageous that the draw-in belt must overcome a large frictional resistance when traveling around this turning rod. The high tensile forces acting on the draw-in belt, can lead to tearing apart of the draw-in belts.

SUMMARY OF THE INVENTION

It is the object of the invention to create a turning rod which can be encircled by a paper web from "two sides".

In accordance with the invention, this object is attained by providing a turning rod that has an outer guide tube which has air outlets on a portion of its surface. The guide tube is supported between two holders and is rotatable about its longitudinal axis. Such rotation relocates the guide tube air outlets so that they will be properly situated in respect to the direction of travel of a paper web being turned by the turning rod.

The advantages which can be achieved by the present invention reside in that the turning rod can be encircled from both sides, i.e. from a left side or half or from a right side or half by a paper web. The half of the tube facing the paper web respectively has air outlet openings which can be moved with little effort by half a turn of the tube. It is therefore possible to eliminate the need for a conversion or replacement of turning rods particularly in those cases where the partial paper webs are merged at a different place in so-called merging towers, i.e. on another level of the merging tower. It furthermore is advantageous that a helically-shaped guide groove, on which compressed air is blown, is provided on a holder portion of the turning rod of the present invention for the smooth guidance of a moving draw-in belt. Discharge or blowing of air on the guide groove advantageously only takes place for the period of time of the actual passage of the draw-in belt through the guide groove.

Further than that, it is also advantageous, for the universal use of the turning rod, if a second guide groove, which is arranged in the opposite direction to the first guide groove, is provided on the holder.

BRIEF DESCRIPTION OF THE DRAWINGS

An exemplary embodiment of the invention present is represented in the drawings and will be described in more detail in what follows.

Shown are in.

DESCRIPTION OF THE PREFERRED EMBODIMENT

Figure 1:
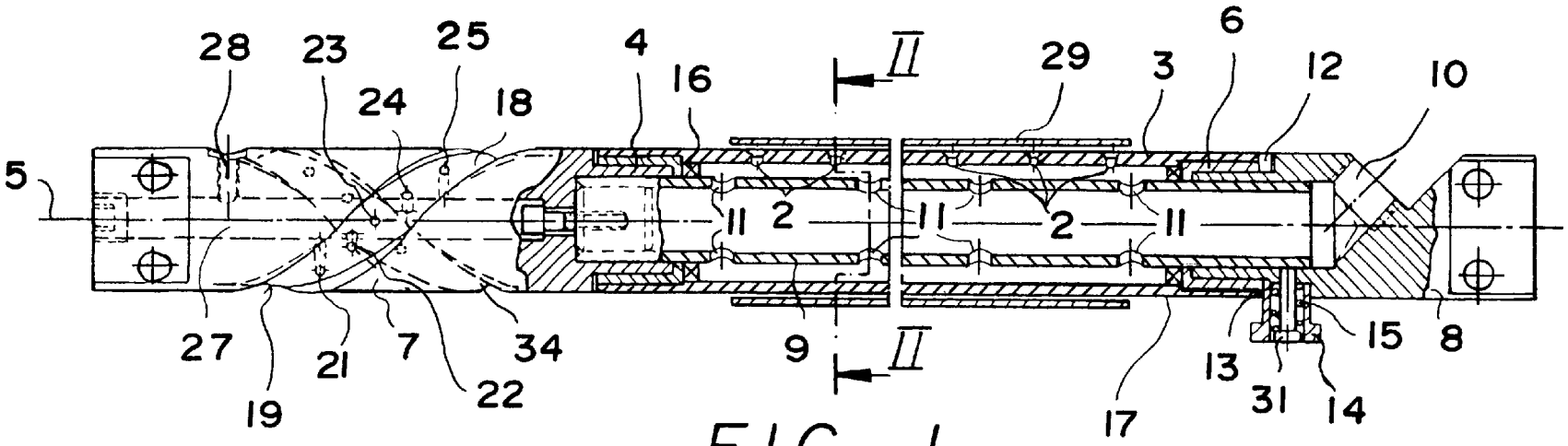
FIG. 1, a front elevation view of a turning rod in accordance with the invention, partially cut along the line I—I in FIG. 2.
Figure 3:
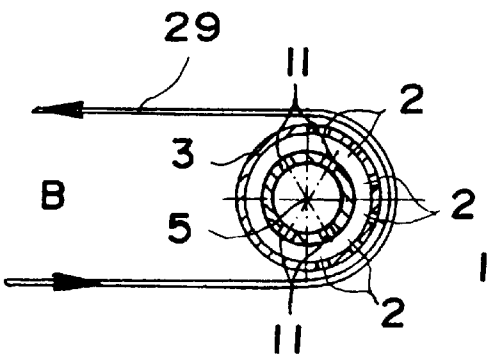
FIG. 3, a cross section analogous to FIG. 2, but with the guide tube turned by 180° into the end position B.
Figure 2:
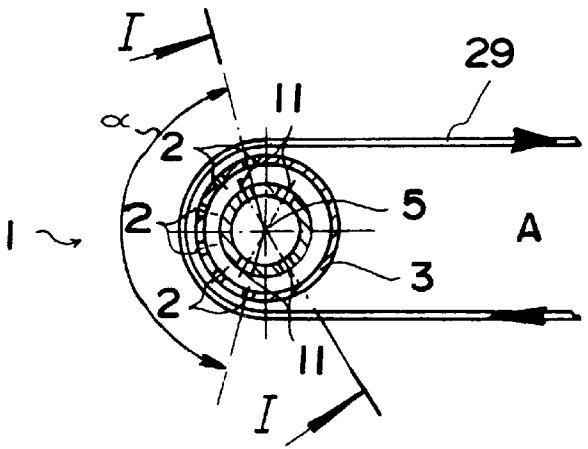
FIG. 2, a cross section through a turning rod in accordance with the present invention, wherein the cross section runs through the air outlet openings of the guide tube and of the connecting tube, such as is represented along the section line II—II in FIG. 1; the guide tube being shown in the end position A.

A turning rod 1 consists of a tube, for example a guide tube 3, provided with air outlet openings 2. By means of bearing bushings 4, 6 on both of its ends, the guide tube 3 is arranged in holders 7, 8, fixed on the lateral frame, at an angle of 45° in respect to the running direction of the paper web, for example by means of clamps, not represented, or possibly also by means of cross bars fixed on the lateral frame. The air outlet openings 2 are distributed over a portion of the circumference of the guide tube 3 at a circumferential angle of less than 165°, and over a length of the guide tube corresponding to a width of the paper web less an amount, for example 30 mm, for a projecting length. An inner connecting tube 9 has air supply outlet openings 11 distributed over its entire length and its circumference. On one of its ends, the connecting tube 9 is connected with a connector 10, located in the right holder 8, for low-pressure air supplied at an air pressure of, for example, 0.3 to 0.6 bar. The guide tube 3 can be rotated around its longitudinal axis of rotation 5 by 180° from a first end position A, that is shown in FIGS. 1 and 2 into a second end position B that is shown in FIG. 3.

The guide tube 3 is seated so it can be fixed in place in either of its respective end positions A or B. This can be achieved, for example, in that two semi-circular recesses 12, 13, which are diametrically located opposite each other at the circumference of tube 3, are arranged at one end of tube 3, wherein respectively one recess 12 or 13 selectively acts in engagement against an engagement lever 14, which can be moved in a radial direction in respect to the guide tube 3. The engagement lever 14 is moved against the force of a spring 15, which is supported between the head of a threaded bolt 31 fixed in place on the holder, and a collar 32 of the engagement lever 14.

The bearing bushings 4, 6 can be made of plastic and may be pressed on the holder 7, 8. Seal rings 16, 17 have been inserted for sealing the low-pressure blowing air against flowing through the gaps in the sliding bearing.

Figure 4:
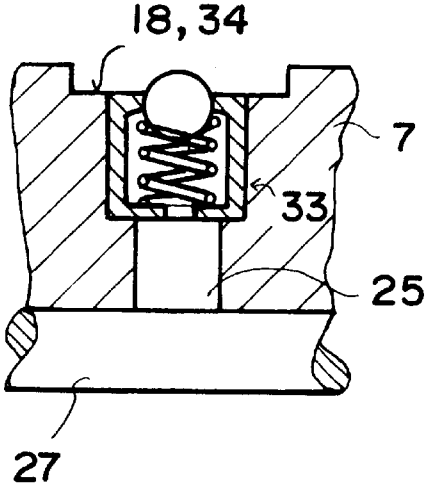
FIG. 4, an enlarged representation of an air outlet opening, located in a guide groove, in the state of rest.

A holder 7 of the guide tube 3 has a helically-shaped guide groove 18 for receiving a draw-in belt, not represented, for a material web. Air outlet openings 21 to 25 are located on the guide groove bottom or the bottom surface 19 of the groove openings 21 to 25 are embodied as radial bores and terminate at their inner ends in an variably extending central bore 27 of the left holder 7. A known ball seat valve 33, as seen in FIG. 4, is advantageously arranged at the radial outer end of each air outlet opening 21 to 25 in the bottom surface 19 of the groove 18. Openings of the ball seat valve 33 takes place when the draw-in belt moves through the helical guide groove. In this way, an air cushion can form between the underside of the draw-in belt and the guide groove 18, which air cushin reduces the friction between the two parts.

The axial bore 27 is connected with a connector 28 for high-pressure blowing air at an air pressure of, for example 1.5 to 4 bar, located on, or respectively in the holder 7. The helically-shaped guide groove 18 makes half a turn on the circumference of the left holder 7, so that it becomes possible to smoothly guide a draw-in belt for a material web, for example a paper web 29, over the turning rod 1.

It is furthermore advantageous for the universal use of the turning rod 1 if at least one, for example the left, holder 7 has a second helical guide groove 34, which is arranged with the opposite hands or turning direction in relation to the first guide groove 18. This second guide groove 34 is embodied the same as the previously described first guide groove 18 and is also equipped with air outlet openings, not specifically shown. It is also possible to structure the right holder 8 with a first guide groove 18 or with a second guide groove 34.

It is furthermore possible to cut a guide groove into both of the holders 7, 8 of the turning rod 1, wherein the guide grooves then should run in the opposite directions from each other. In this case, a separate connector for high-pressure blowing air is then also provided to each of the helical guide grooves.

While a preferred embodiment of a turning rod in accordance with the present invention has been set forth fully and completely hereinabove, it will be apparent to one of skill in the art that a number of changes in, for example, the type of printing press used, the source of the high and low pressure compressed air, the drive for the web draw-in belt and the like can be made without departing from the true spirit and scope of the present invention which is accordingly to be limited only by the following claims.

What is claimed is:

1. A turning rod comprising:

a guide tube having a web guide area;

a plurality of air outlets formed in said web guide area:

spaced first and second holders for said guide tube;

at least one helically shaped guide groove on said turning rod;

guide groove air openings in said guide groove;

means for rotating said guide tube in said holders about a longitudinal axis between first and second positions;

means for supplying compressed air to said air outlets; and means for supplying compressed air to said air openings.

2. The turning rod of claim 1 further including a connecting tube supported between said spaced holders and within said guide tube, said connecting tube having air supply outlet openings.

3. The turning rod of claim 2 further including an air supply connector in one of said spaced holders in contact with said connecting tube.

4. The turning rod of claim 1 wherein at least one of said spaced holders is provided with said at least one helically shaped guide groove, said at least one guide groove having a bottom surface, said guide groove air openings being situated on said bottom surface.

5. The turning rod of claim 4 further including a second helically shaped guide groove in said at least one holder, said first and second helical guide grooves having opposite turning directions.

6. The turning rod of claim 4 wherein said helically shaped guide groove performs a half turn on said holder.

7. The turning rod of claim 6 further including a high pressure air connector in contact with said central bore.

8. The turning rod of claim 4 further including a central bore in said holder, said central bore being in connection with said guide tube air openings.

9. The turning rod of claim 1 further including a ball seat valve in each of said guide groove air openings.

10. The turning rod of claim 1 further including means for fixing said guide tube selectively in said first and second positions.

* * * * *